US007446776B2

(12) United States Patent
Clewett et al.

(10) Patent No.: US 7,446,776 B2
(45) Date of Patent: Nov. 4, 2008

(54) DISPLAY CONTROLLER WITH DRAM GRAPHIC MEMORY

(75) Inventors: David Clewett, Wootton Bassett (GB); Toshiki Kitaguchi, Swindon (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 646 days.

(21) Appl. No.: 10/929,666

(22) Filed: Aug. 30, 2004

(65) Prior Publication Data

US 2006/0044293 A1 Mar. 2, 2006

(30) Foreign Application Priority Data

Aug. 20, 2004 (EP) ..... 04368061

(51) Int. Cl.
*G06G 13/16* (2006.01)

(52) U.S. Cl. ..... 345/530; 345/204; 345/531; 345/532; 345/537; 345/538; 710/100; 711/100; 711/101

(58) Field of Classification Search ..... 345/204, 345/501, 519, 530, 531, 532, 537, 538; 710/1, 710/100, 104; 711/100, 101, 106, 10
See application file for complete search history.

(56) References Cited

U.S. PATENT DOCUMENTS

| | | | | |
|---|---|---|---|---|
| 6,002,411 | A * | 12/1999 | Dye | 345/542 |
| 6,128,025 | A | 10/2000 | Bright et al. | 345/504 |
| 6,653,998 | B2 | 11/2003 | Lin et al. | 345/98 |
| 6,662,311 | B2 * | 12/2003 | Itoh et al. | 714/15 |
| 6,704,234 | B2 | 3/2004 | Mizugaki | 365/222 |
| 7,239,305 | B1 * | 7/2007 | Nakano et al. | 345/179 |
| 2001/0009410 | A1 * | 7/2001 | Fujita | 345/8 |
| 2002/0067648 | A1 * | 6/2002 | Lee | 365/222 |
| 2002/0109679 | A1 * | 8/2002 | Masunaga | 345/212 |
| 2002/0163513 | A1 | 11/2002 | Tsuji | 345/204 |
| 2004/0075653 | A1 * | 4/2004 | Shiuan et al. | 345/204 |
| 2004/0128424 | A1 * | 7/2004 | Matsushita et al. | 710/309 |
| 2005/0174356 | A1 * | 8/2005 | Paterson | 345/567 |
| 2006/0041711 | A1 * | 2/2006 | Miura et al. | 711/103 |

FOREIGN PATENT DOCUMENTS

| | | |
|---|---|---|
| EP | 0777207 A | 6/1997 |
| EP | 0809230 A | 11/1997 |
| EP | 1411492 A | 4/2004 |

* cited by examiner

*Primary Examiner*—Richard Hjerpe
*Assistant Examiner*—Vince E Kovalick
(74) *Attorney, Agent, or Firm*—Saile Ackerman LLC; Stephen B. Ackerman

(57) ABSTRACT

A system, a circuit and a method are given, to realize a display control and driver interface with graphic display memory, whereby the use of dynamic RAM rather than static RAM for this graphic display memory is new. This has the advantage, that for a given size of display memory (number of bits) the DRAM silicon area is significantly less than that of the SRAM. Said system and circuit are designed in order to be implemented with a very economic number of components, capable to be realized with modern monolithic integrated circuit technologies and implementing the given method. This display controller and driver chip can then be used for all LCD display devices including STN (Super Twisted Nematic), CSTN (Colour STN), TFT (Thin Film Transistor) LCD's and for OLED (Organic Light Emitting Diode) displays.

34 Claims, 10 Drawing Sheets

FIG. 1 – Prior Art

DISPLAY CONTROLLER WITH DRAM GRAPHIC MEMORY

BACKGROUND OF THE INVENTION (1) Field of the Invention

The present invention generally relates to a display control circuit and a display control method for use with a display system in an information processing apparatus such as a portable computer, a digital camera, a Personal Digital Assistant (PDA), a modern mobile phone, or a combination thereof as a portable information device which uses a Liquid Crystal Display (LCD) device and relates more particularly to a driving circuit and a driving method for an LCD having row and column or common and segment electrodes. Even more particularly, the present invention relates to an LCD or other display controller as integrated semiconductor device with graphic display memory, which holds data by refreshing, a method of refreshing said memory, and relates specifically to an improvement of primarily this graphic display memory.

(2) Description of the Prior Art

Graphical LCD displays such as those used e. g. on mobile information terminals etc. need a specific controller circuit for their proper operation. Such LCD controllers are used to control the operation of the LCD display and supply the display drivers with appropriate data. An important feature of these LCD display interfaces is the use of Random Access Memory (RAM) for graphic display data storage purposes. Up to now, the graphic display memory in LCD interface chips has been realized as a Static Random Access Memory (SRAM). These LCD interface chips are normally used for Super Twisted Nematic (STN) displays, Colour STN (CSTN) displays and Thin Film Transistor (TFT) LCD displays.

A traditional LCD interface of prior art is shown in FIG. 1 prior art. Its main components are a Chip Controller 20 consisting of a RAM address and timing controller, configuration registers, and timing control of the Display Control 50 circuit, and bi-directionally connected by an internal bus system to a separate Data Interface 30 and to Control Registers 40 and to the already mentioned Graphic Display RAM 10 implemented in SRAM technology. SRAM memories do not need to be refreshed in order to maintain their contents, they are normally constructed however from rather complex multi-transistor memory cells, generally in form of flip-flops. Said Data Interface 30 communicates with an external information processing apparatus via a Control Input 32 and a Data Input/Output bus system 35. Chip Controller 20, Control Registers 40 and Graphic Display RAM 10 are feeding said Display Control 50 circuit thus receiving control and display data signals. This Display Control 50 circuit in turn controls the Common Drivers 60 and the Segment Drivers 70 in this case, which are then driving all the respective electrodes (via 62-68 and via 72-78) of the LCD device. These drivers are supplied with power from an external Driver Supply 65. For a simple black and white display (with no greyscale) there is a one to one mapping of LCD pixels to bits in the Graphic Display RAM. In colour displays, typically, each pixel of the LCD is split into 3 parts: red, green and blue. Each LCD pixel is mapped to a fixed number of memory bits in the Display RAM. This is typically 16 bits (5 bits for red, 6 for green and 5 for blue) for a display capable of displaying 65K colours. Display information (text, picture etc.) is now downloaded into the LCD driver chip Graphic Display RAM 10 through the Data Interface 30 and held in the SRAM as long as power is supplied to the chip. The data is displayed by scanning (reading) one line of the Graphic Display RAM 10 at a time.

The main problem in manufacturing such an LCD interface in modern integrated circuit technologies is hereby the huge amount of chip floor space consumed for the Static RAM (SRAM) used as Graphic Display RAM (one SRAM memory cell can use up to eight transistors) and thus the resulting costs for these chips.

Preferred prior art realizations are implementing such LCD interface controller circuits in single chip or multiple chip solutions as integrated circuits. The large chip areas needed and consequently the high costs are the main disadvantages of these prior art solutions. It is therefore a challenge for the designer of such devices and circuits to achieve a high-quality but also low-cost solution.

Several prior art inventions referring to such solutions describe related methods, devices and circuits, and there are also several such solutions available with various patents referring to comparable approaches, out of which some are listed in the following:

U.S. Pat. No. 6,128,025 (to Bright et al.) describes an embedded frame buffer system and synchronization method wherein a multiple embedded memory frame buffer system includes a master graphics subsystem and a plurality of slave graphics subsystems. Each subsystem includes a frame buffer and a color palette for decompressing data in the frame buffer. The master subsystem further includes a digital to analog converter coupled to receive the decompressed digital data from the palette of each subsystem and outputting analog versions of the digital data to an output device. The system further includes a timing system for determining which outputs of the subsystems are to be converted by the digital to analog converter at a given time. A method of synchronization of embedded frame buffers for data transfer through a single output includes the steps of generating a first clock signal and a second clock signal in a master embedded frame buffer, sending the first and second clock signals to a slave embedded frame buffer and delaying the second clock signal to be in phase with a third clock signal generated by a graphics controller such that no data is lost when transferring data from the master and slave embedded frame buffers.

U.S. Pat. No. 6,653,998 (to Lin et al.) shows an LCD driver for layout and power savings, wherein a driver circuit for use in driving displays has an input receiving a digital input data having n bits for selecting one of a plurality of voltage levels for driving the circuit. The circuit also has an output, a plurality of digital signal lines coupled to the digital input data, and a plurality of active regions coupled to a first side of the output. Each of the plurality of active regions is coupled to a separate voltage level. The circuit further includes a plurality of pass transistors at a first subset of locations where the plurality of digital signal lines overlap the plurality of active regions, and a plurality of depletion-implanted transistors at a second subset of locations where the plurality of digital signal lines overlap the plurality of active regions. The number of the plurality of digital signal lines on one side of the output can be odd number, such as 2n-1, or can be 2n-2. A plurality of blocking transistors can positioned between the input and selected digital signal lines, with at least one of the digital signal lines being coupled to a gate of each of the blocking transistors for controlling each of the blocking transistors. A level-shifter can also be positioned between selected active regions for one or more digital signal line.

U.S. Pat. No. 6,704,234 (to Mizugaki) discloses a semiconductor device, refreshing method thereof, memory system, and electronic instrument whereby a method of refreshing a semiconductor device such as a Video Static RAM (VSRAM) is given. A memory cell array of a semiconductor device is divided into four blocks consisting of a block A, block B, block C, and block D. During a period in which data read or write operations is performed for one of the blocks, refreshing is performed for the other blocks. A Re-Fresh (RF) address controller has a function of making logic of a signal RFA.sub.18 and a signal RFA.sub.19 among refresh address signals RFA.sub.8 to RFA.sub.19 constant so that only part of each block of the blocks A to D is refreshed in a power saving state.

Although these papers describe circuits and/or methods close to the field of the invention they differ in essential features from the method, the system and especially the circuit introduced here.

SUMMARY OF THE INVENTION

A principal object of the present invention is to realize an LCD interface or another display e.g. OLED interface in form of very manufacturable integrated circuits at low cost.

Another principal object of the present invention is to provide a method for implementing control and drive functions for LCD and OLED devices realizable with the help of integrated circuits.

Also further an object of the present invention is the inclusion of dynamic rather than static RAM for the LCD or OLED driver memory device.

Also an object of the present invention is to include a DRAM as graphic memory into LCD or OLED interface circuits and at the same time to reach for a low-cost realization with modern integrated circuit technologies.

Further an object of the present invention is to realize an LCD or OLED control and driver interface for portable information devices.

Another further object of the present invention is to combine the write/read/refresh operation for the graphic DRAM with modern Multi-Line Addressing schemes.

A still further object of the present invention is to reduce the power consumption of the circuit by realizing inherent appropriate design features.

Another further object of the present invention is to reduce the cost of manufacturing by implementing the circuit as a monolithic integrated circuit in low cost CMOS technology.

Another still further object of the present invention is to reduce cost by effectively minimizing the number of expensive components.

In accordance with the objects of this invention a new circuit is described, implementing a display interface chip, capable of realizing control and driver functions for external Liquid Crystal Display (LCD) and Organic Light Emitting Diode (OLED) devices and communicating with an external information processing system, comprising. a Chip Controller block controlling all write, read and refresh operations within the circuit; a Graphic Display DRAM block implemented in DRAM technology; a Refresh Control block therefore; a Data Interface block which communicates with said external information processing system; a Control Input terminal as input into said Data Interface block; a Data Input/Output bus system connecting from said external information processing system to said Data Interface block; a Control Registers block; an internal bus system in order to bi-directionally connect said Chip Controller block with said Control Registers block, said Graphic Display DRAM block and said Data Interface block; a Display Control circuit block controlling said Common and Segment Drivers blocks together with said Refresh Control block and being controlled by said Chip Controller block whereby said Refresh Control block controls in turn said Graphic Display DRAM block and is being controlled itself by said Display Control circuit block; a Driver Supply terminal for connection of an external or internal power supply; output terminals for connecting the electrodes of said external display device; and a Common Drivers and a Segment Drivers block, driving all the respective electrodes of said external display device, whereby said Driver blocks are supplied with power from said Driver Supply terminal.

Also in accordance with the objects of this invention a new method is described, implementing a Display interface circuit, capable of realizing control and driver functions for display devices such as Liquid Crystal Display (LCD) or Organic Light Emitting Diode (OLED) Display devices setup, configured and operated within the framework of a timing and looping schedule, comprising. providing a Chip Controller block; providing as Graphic Display Random Access Memory (RAM) a Dynamic RAM (DRAM) block; providing a Refresh Control block for periodically refreshing the memory cells of said DRAM in order to maintain its information contents during operation; providing a Data Interface block for communicating between said Display interface circuit and an external information processing system; providing a Control Registers block for intermediately storing variable control data; providing a Common Drivers block with outputs driving from first to last Common electrodes said Display device; providing a Segment Drivers block with outputs driving from first to last Segment electrodes said Display device; providing a Display Control block for feeding control and data signals to said Common Drivers and Segment Drivers block; providing a bus system as a bi-directional interconnection means between said Chip Controller block, and said Graphic Display DRAM, Data Interface blocks, and Control Registers blocks; providing Control Input and Data Input/Output signals for said Data Interface from said external information processing system; providing a Driver Supply input for said Driver blocks; connecting output signals from said Chip Controller block to inputs of said Control Registers block and said Refresh Control block; connecting the output from said Graphic Display DRAM, from said Chip Controller block and Control Registers block as inputs to said Display Control block; connecting the output from said Refresh Control block as input to said Graphic Display DRAM block; connecting the output from said Display Control block as input to said Refresh Control block; connecting each with an output from said Display Control block as input to said Common and Segment Drivers blocks respectively; connecting each with their outputs from said Common Drivers block and said Segment Drivers block to said Display device respectively; establishing a looping and timing schedule as operating scheme for said Display Interface circuit capable of implementing graphical Data write and read/refresh cycles with adequate Graphic Display DRAM addressing schemes (e.g. MLA) and thus being able to being continuously operated; initializing with pre-set Control Registers and pre-set data values a start-up operating cycle of said operating scheme for said Display Interface circuit; starting said operating scheme for said Display Interface circuit system by feeding said Control Input and Data Input/Output signals from said external information processing system; writing graphical Data Input into appropriate memory addresses of said Graphic Display DRAM under control and via said Chip Controller block; reading graphical Data from said Graphic Display DRAM under control of said Chip Controller block and via said Display Control block—also under control of said Chip Controller block—respectively into said Common and Segment Drivers for displaying, whereby the action of reading the DRAM automatically refreshes the data just read; displaying said graphical Data stored within said Common and Segment Drivers by driving said Display device appropriately; and restarting again said once established operating scheme for said Display interface circuit from said starting point above and continue its looping schedule.

Further in accordance with the objects of this invention a new system is described, realizing an Information Display (ID) interface, capable of implementing information storage and display functions in connection with control and driver operations for ID devices, comprising Data Interfacing means for communicating between said ID system and external information processing systems; Controlling means for operating said ID system; Display Driver Control means for a controlled feeding of control and data signals into ID Driver means, which drive said ID devices; Display Data Storage means being arranged as Random Access Memory (RAM) of the Dynamic RAM (DRAM) type associated with Memory Control means for reading, writing and periodically refreshing the memory cells of said DRAM in order to maintain its information contents during operation, altogether named as Display DRAM; and an operating method for said ID system with a step of writing information Data received from said Data Interfacing means into said Display DRAM, another step reading said information Data from said Display DRAM under control of said Controlling means and a further step of transferring said information Data via said Display Driver Control means into said ID Driver means for displaying on said ID devices.

BRIEF DESCRIPTION OF THE DRAWINGS

In the accompanying drawings forming a material part of this description, the details of the invention are shown.

DESCRIPTION OF THE PREFERRED EMBODIMENTS

The preferred embodiment discloses a novel LCD controller circuit—especially for portable information devices—with a new implementation for the internal Graphic Display RAM. Instead of the conventional Static Random Access Memory (SRAM) used hitherto now a Dynamic Random Access Memory (DRAM) with according Refresh Control circuit will be employed, altogether realized as a modern integrated circuit for an exemplary implementation. The information (text, picture etc.) to be displayed is transferred into the memory of the LCD controller and driver chip, the Graphic Display RAM, an SRAM in prior art. Now a different kind of memory, a Dynamic Random Access Memory (DRAM) is installed for the same purpose. This novel LCD controller circuit will be used in LCD display driver chips. This is the chip which typically sits on the LCD glass itself, and interfaces between the LCD and a microprocessor to provide control and display data. The microprocessor in question here is external to the LCD controller chip and is, by the way, referred to elsewhere in the patent application as "external information processing system". This LCD controller chip according to the invention can then be used for all LCD display devices including STN (Super Twisted Nematic), CSTN (Colour STN), TFT (Thin Film Transistor) LCD's and OLED (Organic Light Emitting Diode) displays.

Figure 1:
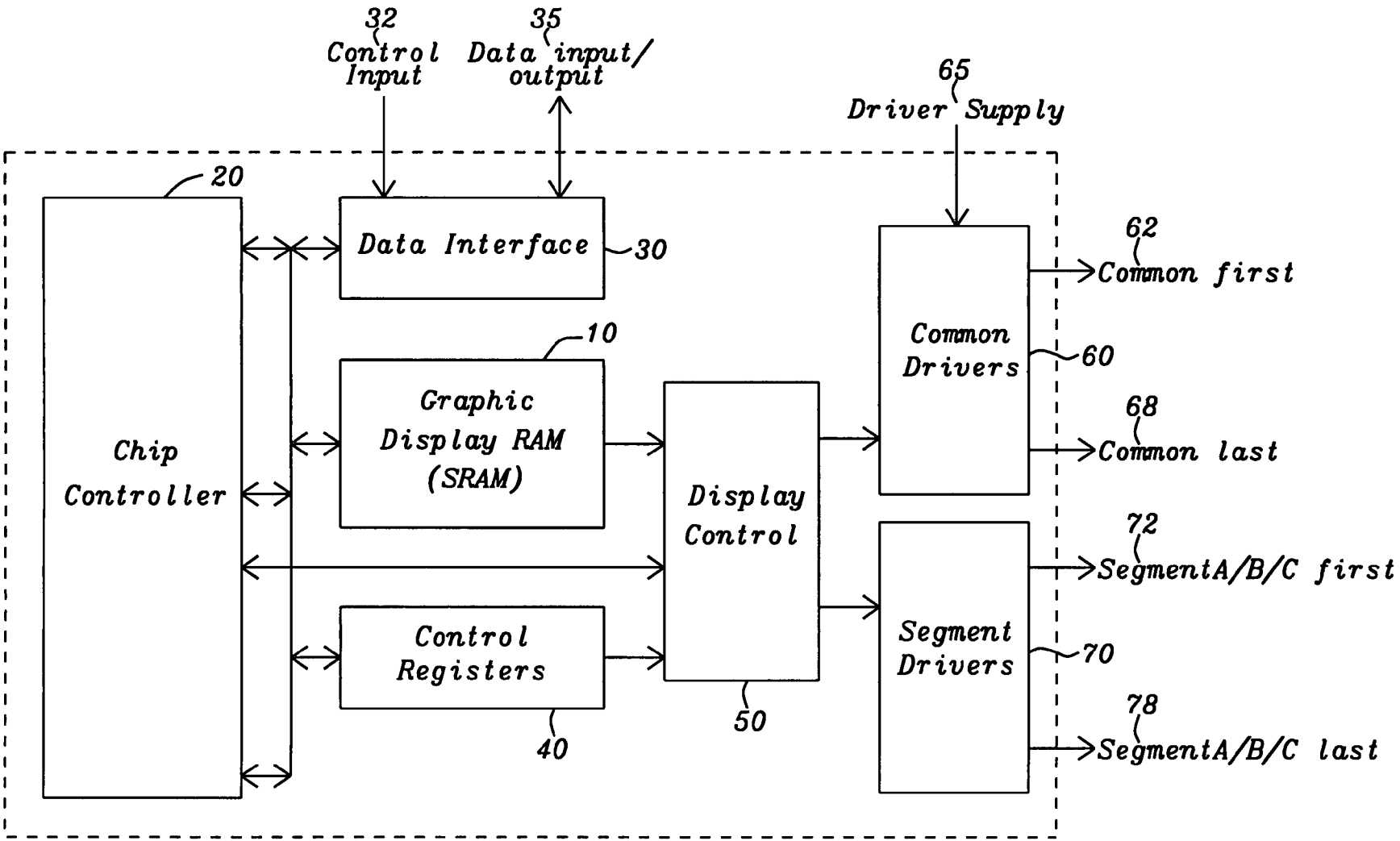
FIG. 1 prior art shows the electrical block diagram for a traditional LCD interface, where the graphic memory is of conventional SRAM design.
Figure 2:
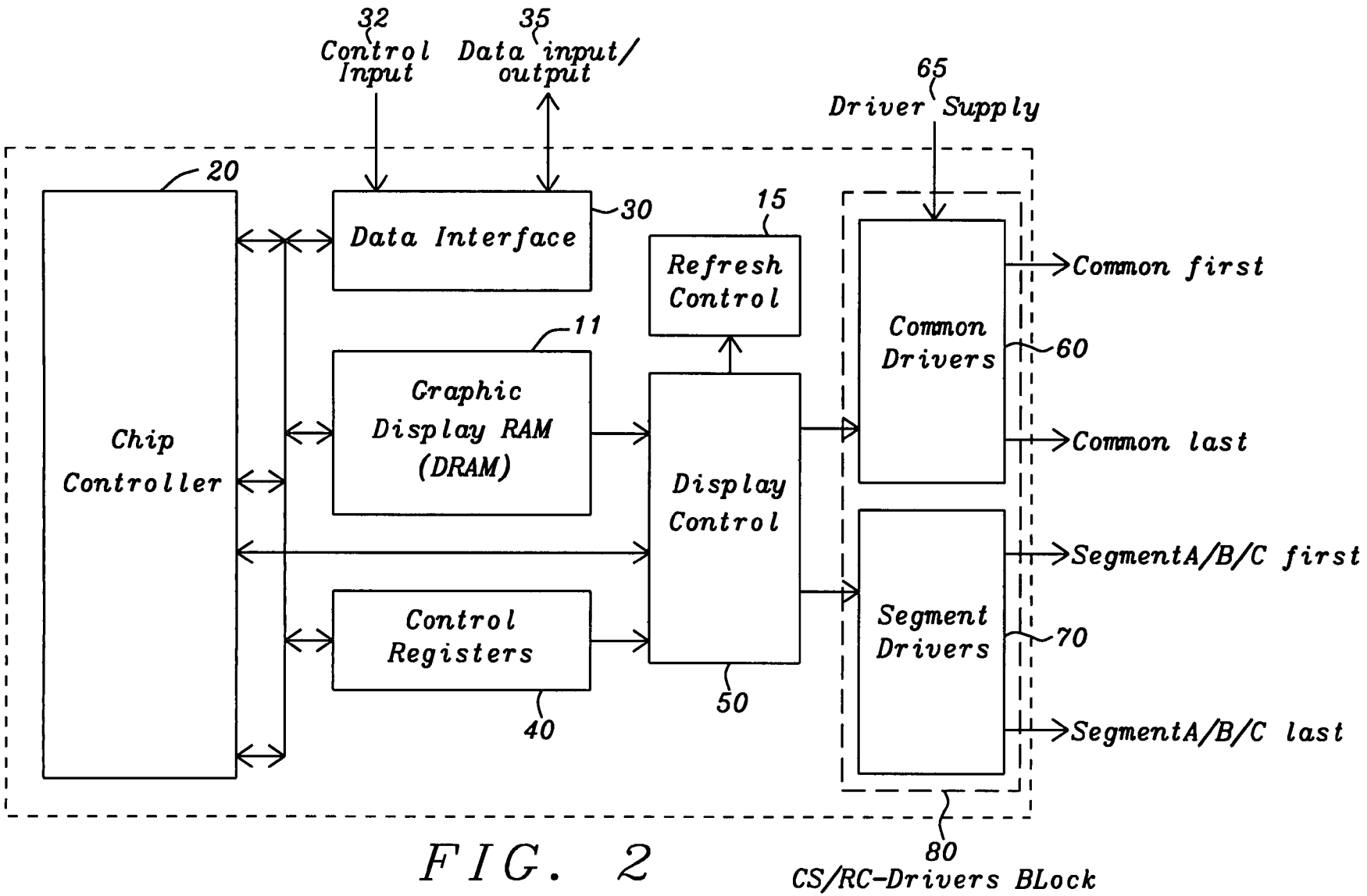
FIG. 2 shows the electrical block diagram for the new LCD interface i.e. controller and driver circuit as the preferred embodiment of the present invention implementable with a variety of modern monolithic integrated circuit technologies.

Contemplating now FIG. 2, a block diagram of the new LCD interface chip with DRAM, we determine by comparing to FIG. 1 prior art, that the external control (32, 35 and 65) of the new LCD interface chip with DRAM 11 is the same as for the traditional chip. However, the data in the DRAM 11 does not remain as long as power is supplied to the chip but must be regularly refreshed. This is achieved using existing circuits inside the Display Control block 50 see FIG. 2 in conjunction with a Refresh Control block 15 (shaded) itself controlled by the main Chip Controller 20, so that each time a line of the Graphic Display DRAM 11 (shaded) is read, the data is automatically refreshed. Same as with the conventional LCD interface its main components are a dedicated microcircuit as Chip Controller 20 consisting of a RAM address and timing controller, configuration registers, and timing control of the Display Control 50 circuit, and bi-directionally connected by an internal bus system to a separate Data Interface 30 and to Control Registers 40 and to the already mentioned Graphic Display RAM 11 together with its Refresh Control 15. This Graphic Display RAM 11 is now implemented in DRAM technology. DRAM memories need to be refreshed in order to maintain their contents, they are constructed from rather simple transistor memory cells with few components for storing electrical charges. Therefore said new Refresh Control block 15 is introduced. Said Data Interface 30 communicates with an external information processing apparatus via a Control Input 32 and a Data Input/Output bus system 35. Chip Controller 20, Control Registers 40 and Graphic Display RAM 15 are feeding a Display Control 50 circuit thus receiving control and display data signals. This Display Control 50 circuit in turn controls the Common Drivers 60 and the Segment Drivers 70 in this case, which are then driving all the respective electrodes (via 62-68 and via 72-78) of the connected LCD device. These drivers are designated together as CS/RC—Drivers block 80 (generally, in datasheets from most manufacturers, "common" and "segment" are used instead of row and column, as normally advised by matrix display nomenclature) and are supplied with power from a Driver Supply 65, which can be an internal or external supply circuit (typically, in modern chips, the drive voltage is generated on chip by charge pumps). The Refresh Control 15 block is advantageously being operated in Multi-Line Addressing (MLA) mode, in order to provide reads to the DRAM 11, to refresh its data, when, for instance, the display itself is switched off, but the data has to be retained. Additionally, the block ensures that reads (refreshes) are sent to the DRAM 11 at an appropriate rate to ensure that the data hold time (between refreshes) is not exceeded. Multi-Line Addressing (MLA) selects more than one row lines of the LCD at the same time. Advantages of MLA are a lower LCD driving voltage requirement which results in power saving, an improved display quality because of faster frame response times and reduced display crosstalk, due also to the lower driving voltages necessary. However the use of MLA requires a much more complicated mathematical calculation on the display data before it can be displayed on the panel.

Figure 3A:
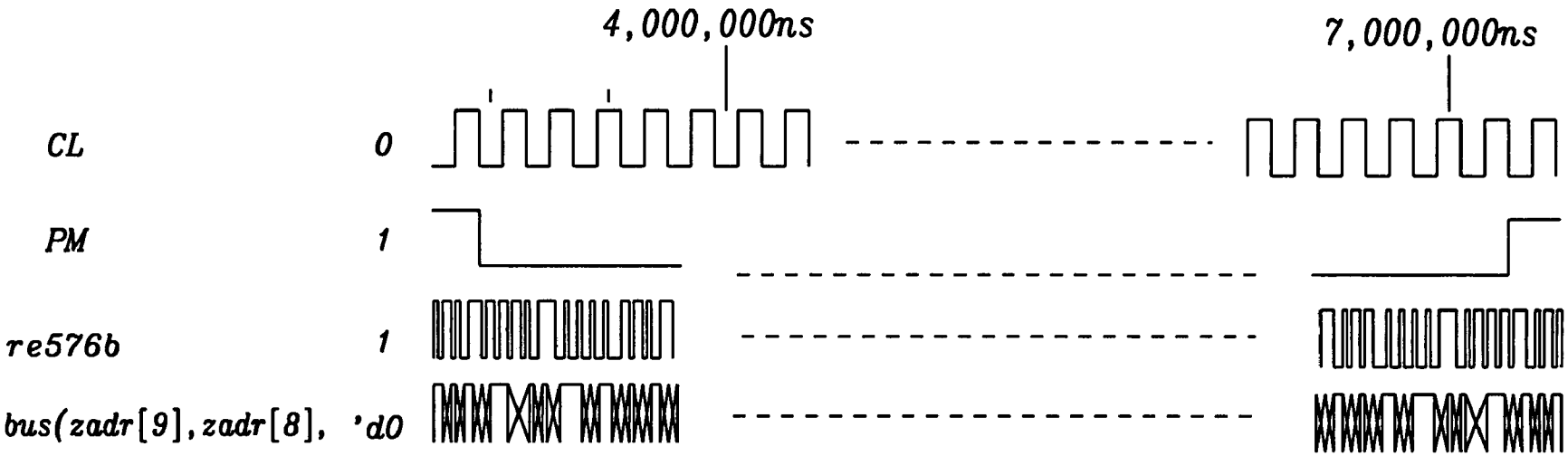
FIGS. 3A & 3B depict in form of timing charts the operation of the Display Control block (in non-DRAM case) or of the Display Control block or the Refresh Control block (in DRAM case) of said controller and driver circuit as shown in FIG. 2.
Figure 3B:
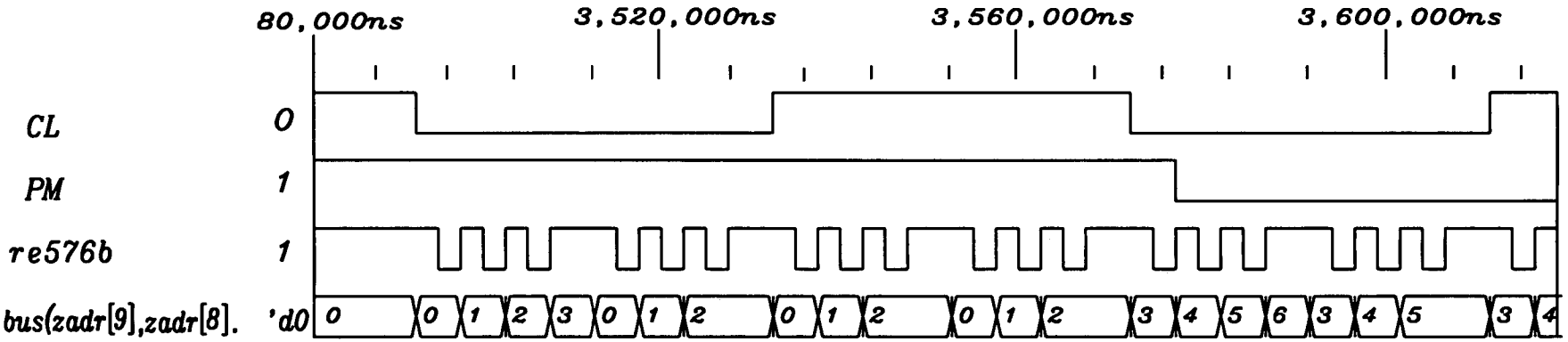
Figure 4A:
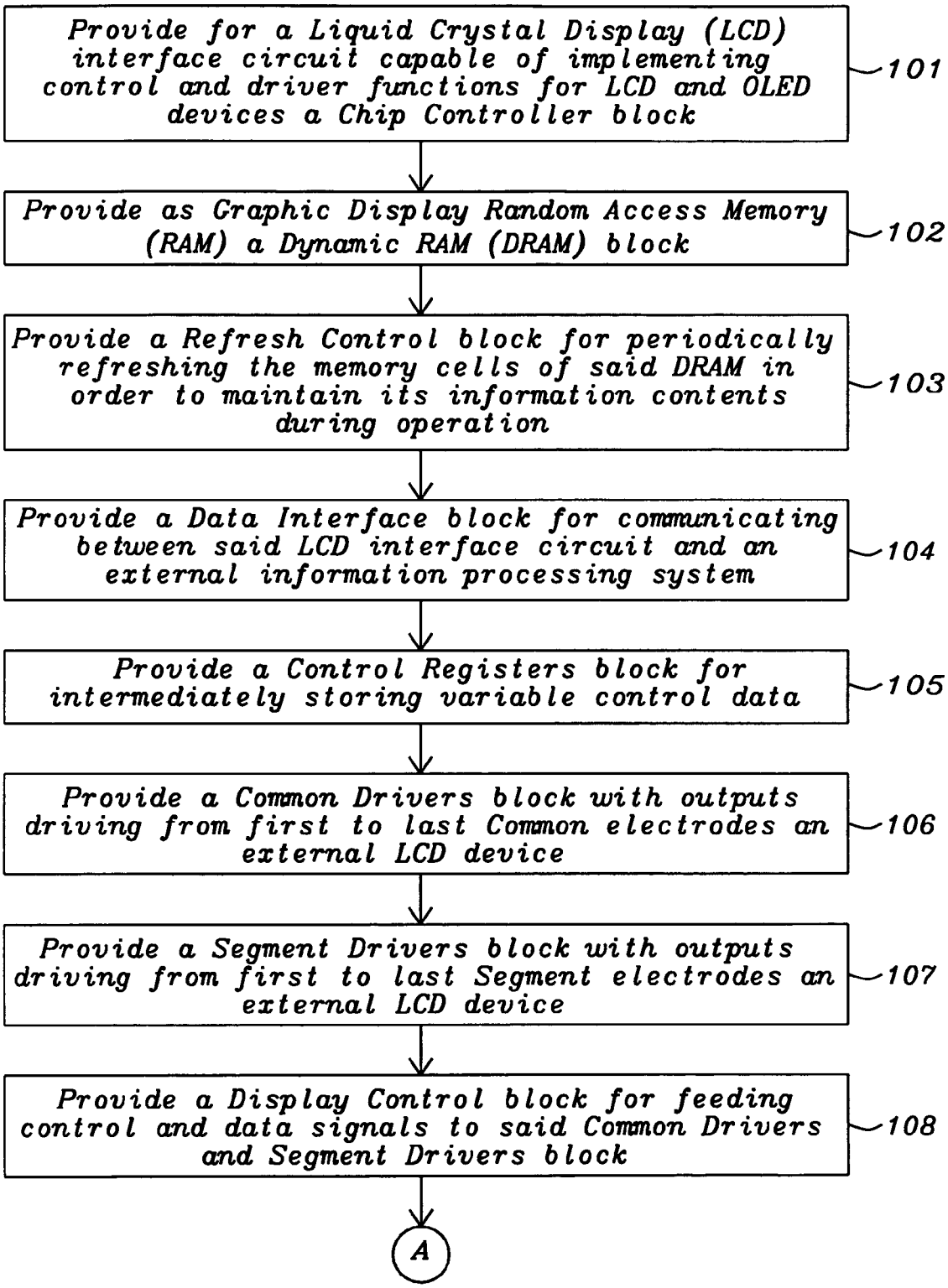
FIGS. 4A-4D describe with the help of a flow diagram the according method for operating said controller and driver circuit as shown in FIG. 2.
Figure 4B:
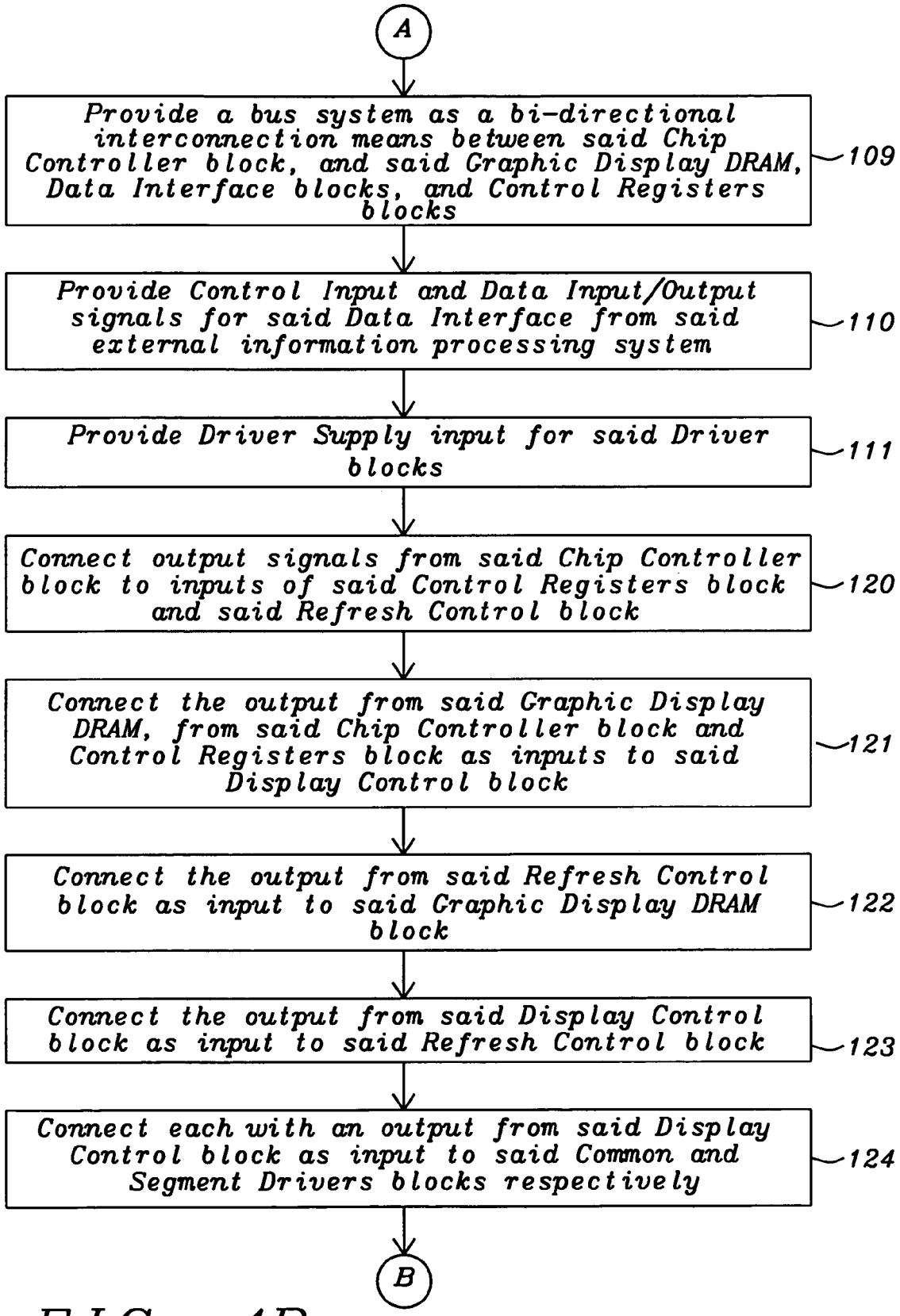
Figure 4C:
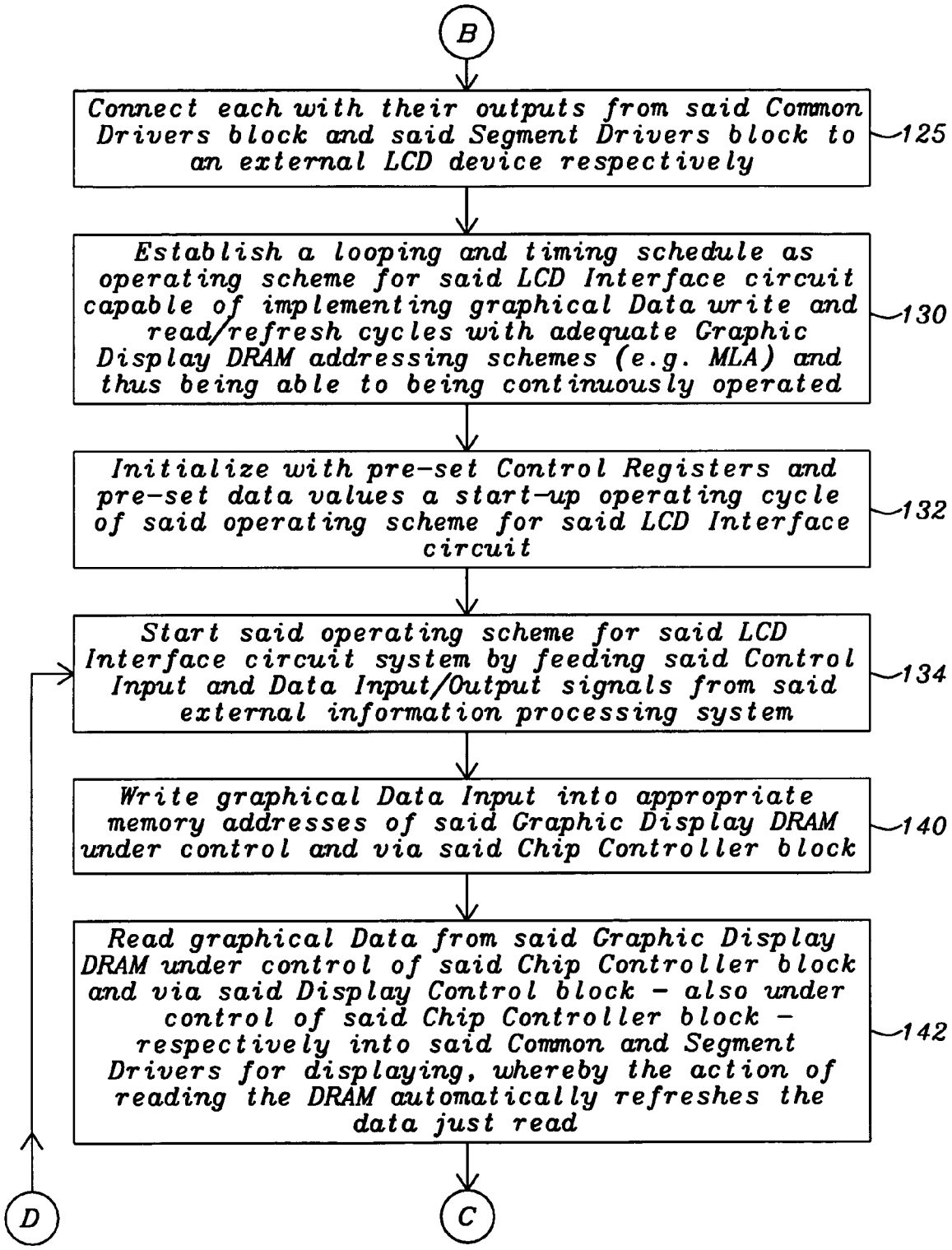
Figure 4D:
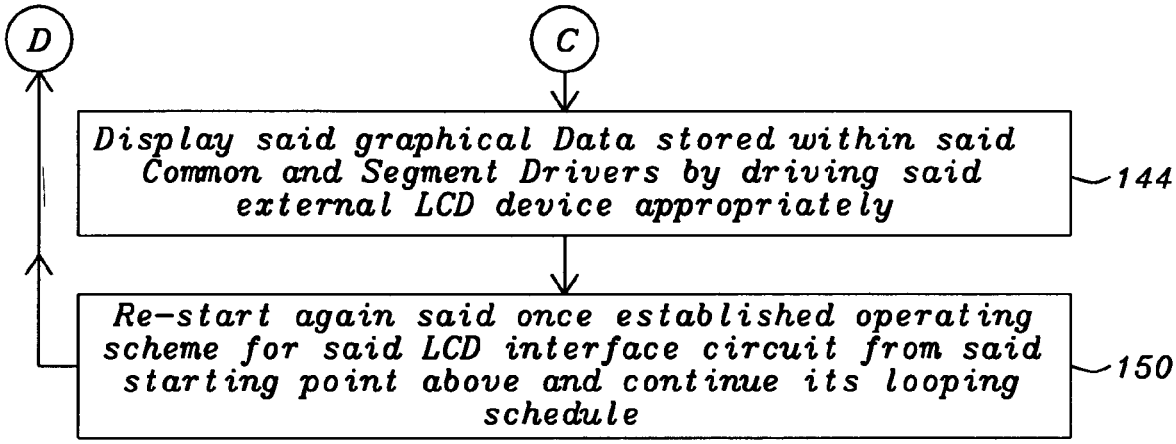

FIG. 3A and FIG. 3B represent two timing diagrams which show the operation of the Display Control block or of the Refresh Control block of the LCD display driver. These timing diagrams show the existing timing (in the non-DRAM i.e. SRAM case) as generated by the existing Display Control block. However the signals shown are also applicable to the new DRAM case where they can be provided also by the Refresh Control block when not being provided by the Display Controller e.g. when the LCD is switched off. In FIG. 3A one complete frame which represents a refresh of the entire RAM can be seen. The action of reading the RAM automatically refreshes the data just read, which is an inherent property of the way DRAM's work. The chart of FIG. 3B zooms in to the beginning of a frame period to show the address for read (zadr), the read enable (re576b) and the common clock (CL). The term PM defines a multiple of the frame frequency (e.g. ×4), and CL as common clock (i.e. line clock) can be f(PM)×60 for example depending on the display size. The frame rate is usually around 70 to 100 Hz. The reading and writing of the RAM is controlled by Refresh or Display Control circuits realizing an "anti-clash" operation. This operation schedules writes and reads to the RAM in a collision free manner, i.e. if a write or read should be requested by the chip controller at the same time, or when the RAM is busy doing a previous access no collisions can occur, such avoiding mutual disturbances of read and write operations. This makes the single port RAM act like a dual port RAM. The example here uses MLA technology which requires that for a single line of display, three lines of data are read from the RAM. As partially shown in FIG. 3B, the RAM is read four times at the same set of three addresses. This is because in this example for an implementation of the circuit of the invention the line of the display requires 2304 bit words but the RAM in the example only outputs 576 bit words, so four accesses are required per display line.

A method, closely belonging to the block diagram of FIG. 2 is now described in greater detail with its steps thoroughly explained according to the flow diagram given in FIGS. 4A-4D, where step one (101) provides for a Liquid Crystal Display (LCD) or Organic Light Emitting Diode (OLED) interface circuit capable of implementing control and driver functions for LCD and OLED devices a Chip Controller block, step two (102) provides as Graphic Display Random Access Memory (RAM) a Dynamic RAM (DRAM) block, step three (103) then provides a Refresh Control block for periodically refreshing the memory cells of said DRAM in order to maintain its information contents during operation, step four (104) provides a Data Interface block for communicating between said LCD interface circuit and an external information processing system. The following step 105 provides a Control Registers block for intermediately storing variable control data and in the next two steps 106 and 107, a Common Drivers block with outputs driving from first to last Common electrodes of an external LCD device is provided and equally a Segment Drivers block with outputs driving from first to last Segment electrodes of said external LCD device. The next method step 108 provides a Display Control block for feeding control and data signals to said Common Drivers and Segment Drivers block, step 109 provides a bus system as a bi-directional interconnection means between said Chip Controller block, and said Graphic Display DRAM, Data Interface blocks, and Control Registers blocks. Providing Control Input and Data Input/Output signals for said Data Interface from said external information processing system and providing Driver Supply input for said Driver blocks concludes steps 110 and 111.

Step 120 now connects the output signals from said Chip Controller block to the inputs of said Control Registers block and said Refresh Control block, step 121 connects the output from said Graphic Display DRAM, from said Chip Controller block and Control Registers block as inputs to said Display Control block, step 122 connects the output from said Refresh Control block as input to said Graphic Display DRAM block Connecting the output from said Display Control block as input to said Refresh Control block makes step 123. Connecting each with an output from said Display Control block as input to said Common and Segment Drivers blocks respectively as well as connecting each with their outputs from said Common Drivers block and said Segment Drivers block to an external LCD device respectively is done in steps 124 and 125.

The following method steps 130, 132, and 134 establish a looping and timing schedule as operating scheme for said LCD Interface circuit capable of implementing graphical Data write and read/refresh cycles with adequate Graphic Display DRAM addressing schemes (e.g. MLA) and thus being able to being continuously operated, initialize with pre-set Control Registers and pre-set data values a start-up operating cycle of said operating scheme for said LCD Interface circuit, and start said operating scheme for said LCD Interface circuit system by feeding said Control Input and Data Input/Output signals from said external information processing system. Steps 140, 142 and 144 writes graphical Data Input into appropriate memory addresses of said Graphic Display DRAM under control and via said Chip Controller block, reads graphical Data from said Graphic Display DRAM under control of said Chip Controller block and via said Display Control block—also under control of said Chip Controller block—respectively into said Common and Segment Drivers for displaying, whereby the action of reading the DRAM automatically refreshes the data just read, and displays said graphical Data stored within said Common and Segment Drivers by driving said external LCD device appropriately. Finally step 150 is restarting again said once established operating scheme for said LCD interface circuit from said starting point above and continues its looping schedule.

Figure 5A:
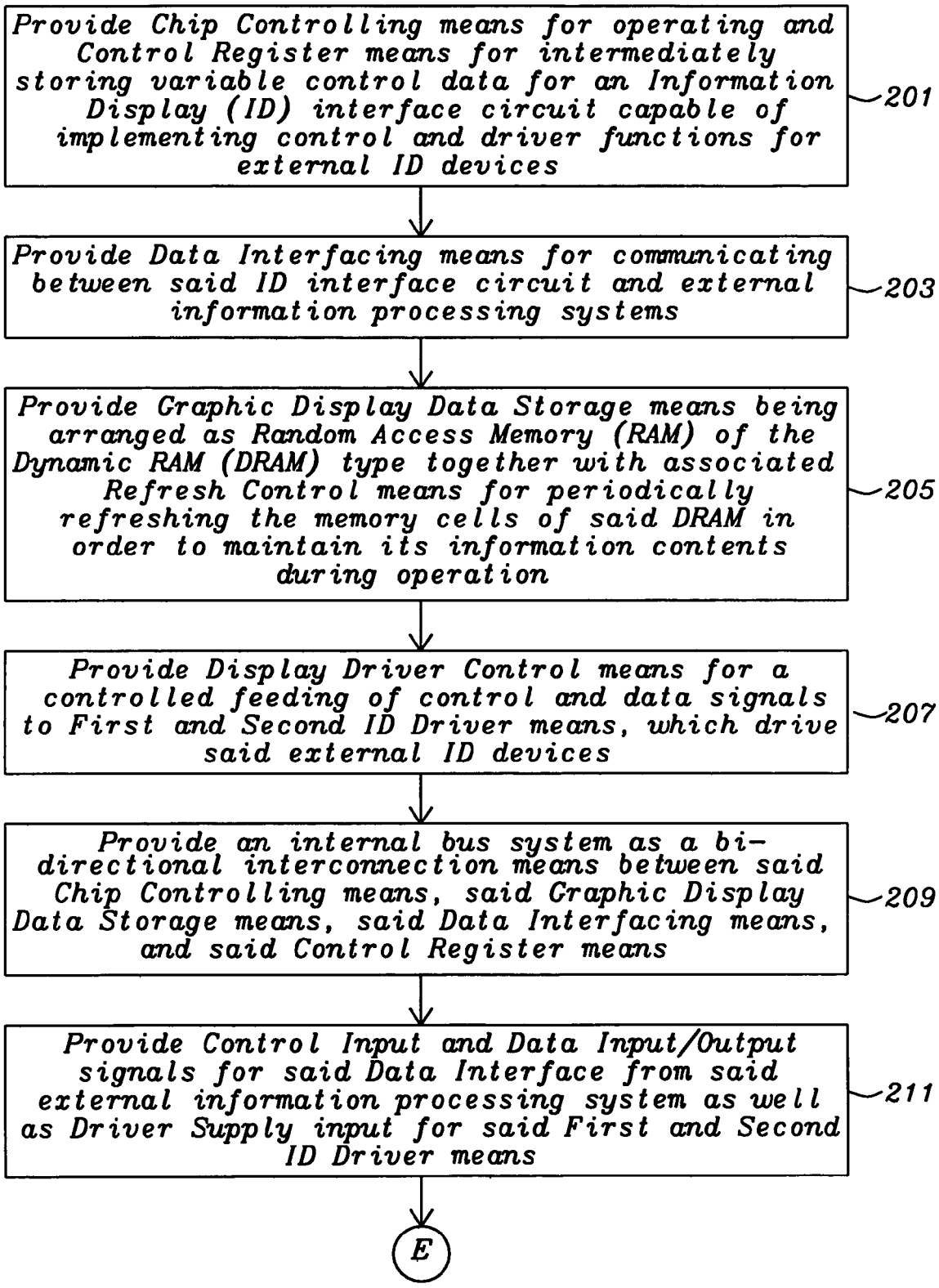
FIGS. 5A-5B describe with the help of a flow diagram a more general method for implementing the LCD controller and driver circuit according to the invention.
Figure 5B:
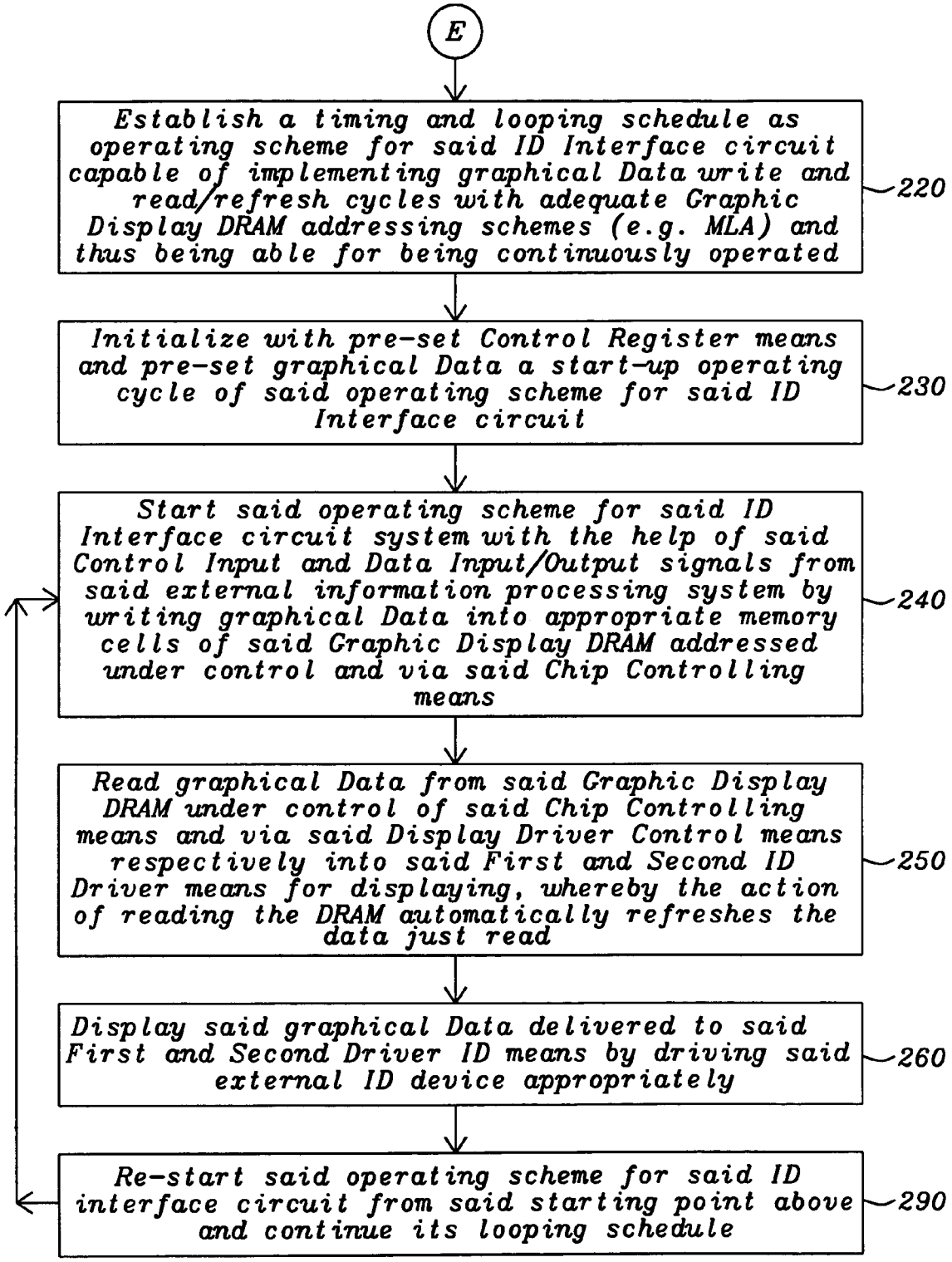

A more general method for implementing an Information Display (ID) controller and driver circuit according to the invention is now described and its steps are explained according to the flow diagram given in FIGS. 5A-5B, whereby two groups of method steps can be discerned: a first group with steps (201-211) for providing all necessary means and a second group with operating steps (220-290).

Step one (201) provides Chip Controlling means for operating and Control Register means for intermediately storing variable control data for an Information Display (ID) interface circuit capable of implementing control and driver functions for external ID devices, step two (203) provides Data Interfacing means for communicating between said ID interface circuit and external information processing systems, step three (205) provides Graphic Display Data Storage means being arranged as Random Access Memory (RAM) of the Dynamic RAM (DRAM) type together with adjoint Refresh Control means for periodically refreshing the memory cells of said DRAM in order to maintain its information contents during operation, step four (207) provides Display Driver Control means for a controlled feeding of control and data signals to First and Second ID Driver means, which drive said external ID devices, step five (209) then provides an internal bus system as a bi-directional interconnection means between said Chip Controlling means, said Graphic Display Data Storage means, said Data Interfacing means, and said Control Register means, and finally step six (211) provides Control Input and Data Input/Output signals for said Data Interface from said external information processing system as well as Driver Supply input for said First and Second ID Driver means.

In order to operate these means just set-up in these first six means providing steps, the method continues with step 220 establishing a timing and looping schedule as operating scheme for said ID Interface circuit capable of implementing graphical Data write and read/refresh cycles with adequate Graphic Display DRAM addressing schemes (e.g. MLA) and thus being able to being continuously operated. Step 230 initializes with pre-set Control Register means and pre-set graphical Data a start-up operating cycle of said operating scheme for said ID Interface circuit. In step 240 the operating loop begins by starting said operating scheme for said ID Interface circuit system with the help of said Control Input and Data Input/Output signals from said external information processing system by writing graphical Data into appropriate memory cells of said Graphic Display DRAM addressed under control and via said Chip Controlling means, then step 250 reads graphical Data from said Graphic Display DRAM under control of said Chip Controlling means and via said Display Driver Control means respectively into said First and Second ID Driver means for displaying, whereby the action of reading the DRAM automatically refreshes the data just read, step 260 now displays said graphical Data delivered to said First and Second ID Driver means by driving said external ID device appropriately and finally step 290 restarts said operating scheme for said ID interface circuit from said starting point above and continues its looping schedule.

Summarizing the essential features of the circuit we find, that this novel LCD controller allows for implementing the memory of an LCD controller and driver chip instead of an SRAM type normally used as a different kind of memory, a Dynamic Random Access Memory (DRAM) for the same purpose, such resulting in a less costly production of these chips.

As shown in the preferred embodiments as described by block diagrams and flow charts the novel system, circuits and methods provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. A circuit, forming a display interface chip, capable of realizing control and driver functions for Liquid Crystal Display (LCD) and Organic Light Emitting Diode (OLED) devices and communicating with an external information processing system, comprising:

a Chip Controller block controlling all write, read and refresh operations within the circuit;

a Graphic Display DRAM block implemented in DRAM technology;

a Refresh Control block therefore;

a Data Interface block which communicates with said external information processing system;

a Control Input terminal as input into said Data Interface block;

a Data Input/Output bus system connecting from said external information processing system to said Data Interface block;

a Control Registers block;

an internal bus system in order to bi-directionally connect said Chip Controller block with said Control Registers block, said Graphic Display DRAM block and said Data Interface block;

a Display Control circuit block controlling said Common and Segment Drivers blocks together with said Refresh Control block and being controlled by said Chip Controller block whereby said Refresh Control block controls in turn said Graphic Display DRAM block and is being controlled itself by said Display Control circuit block;

a Driver Supply terminal for connection of an external or internal power supply;

output terminals for connecting the electrodes of said external display device; and a Common Drivers and a Segment Drivers block, driving all the respective electrodes of said external display device, whereby said Driver blocks are supplied with power from said Driver Supply terminal.

2. The circuit according to claim 1 wherein said display device is an LCD device of the Super Twisted Nematic (STN) displays type.

3. The circuit according to claim 1 wherein said display device is an LCD device of the Colour STN (CSTN) displays type.

4. The circuit according to claim 1 wherein said display device is an LCD device of the Thin Film Transistor (TFT) displays type.

5. The circuit according to claim 1 wherein said display device is an Organic Light Emitting Diode (OLED) device displays type.

6. The circuit according to claim 1 wherein said Chip Controller block is realized in form of a dedicated logic circuit.

7. The circuit according to claim 1 wherein said Chip Controller block is realized in form of a finite state machine.

8. The circuit according to claim 1 wherein said Refresh Control block is operating in such a way, that during read operations necessary refresh operations are concurrently fulfilled.

9. The circuit according to claim 8 wherein said Refresh Control block is operating in anti-clash mode.

10. The circuit according to claim 1 wherein said Display Control block is operating in such a way, that during read operations necessary refresh operations are concurrently fulfilled.

11. The circuit according to claim 10 wherein said Display Control block is operating in anti-clash mode.

12. The circuit according to claim 1 wherein said Graphics Display DRAM block is addressed in Multi-Line Addressing (MLA) mode.

13. The circuit according to claim 1 manufactured using modern integrated circuit technologies.

14. The circuit according to claim 13 manufactured in CMOS technology.

15. The circuit according to claim 13 manufactured as a single chip in CMOS technology.

16. A method for implementing an Information Display (ID) interface circuit, capable of realizing control and driver functions for ID devices set-up, configured and operated within the framework of a timing ad looping schedule, comprising:

providing Chip Controlling means for operating and Control Register means for intermediately storing variable control data for an Information Display (ID) interface circuit capable of implementing control and driver functions for ID devices;

providing Data Interfacing means for communicating between said ID interface circuit and external information processing systems;

providing Graphic Display Data Storage means being arranged as Random Access Memory (RAM) of the Dynamic RAM (DRAM) type together with adjoint Refresh Control means for periodically refreshing the memory cells of said DRAM in order to maintain its information contents during operation;

providing Display Driver Control means for a controlled feeding of control and data signals to First and Second ID Driver means, which drive said ID devices;

providing an internal bus system as a bi-directional interconnection means between said Chip Controlling means, said Graphic Display Data Storage means, said Data Interfacing means, and said Control Register means;

providing Control Input and Data Input/Output signals for said Data Interface from said external information processing system as well as Driver Supply input for said First and Second ID Driver means;

establishing a timing and looping schedule as operating scheme for said ID Interface circuit capable of implementing graphical Data write and read/refresh cycles with adequate Graphic Display DRAM addressing schemes (e.g. MLA) and thus being able to being continuously operated;

initializing with pre-set Control Register means and pre-set graphical Data a start-up operating cycle of said operating scheme for said ID Interface circuit;

starting said operating scheme for said ID Interface circuit system with the help of said Control Input and Data Input/Output signals from said external information processing system by writing graphical Data into appropriate memory cells of said Graphic Display DRAM addressed under control and via said Chip Controlling means;

reading graphical Data from said Graphic Display DRAM under control of said Chip Controlling means and via said Display Driver Control means respectively into said First and Second ID Driver means for displaying, whereby the action of reading the DRAM automatically refreshes the data just read;

displaying said graphical Data delivered to said First and Second ID Driver means by driving said ID device appropriately; and restarting said operating scheme for said ID interface circuit from said starting point above in order to continue its looping schedule.

17. The method according to claim 16 wherein said ID device is of the Super Twisted Nematic (STN) displays type.

18. The method according to claim 16 wherein said ID device is of the Colour STN (CSTN) displays type.

19. The method according to claim 16 wherein said ID device is of the Thin Film Transistor (TFT) displays type.

20. The method according to claim 16 wherein said ID device is of the Organic Light Emitting Diode (OLED) displays type.

21. The method according to claim 16 wherein said First ID Driver is an LCD Common driver.

22. The method according to claim 16 wherein said First ID Driver is an OLED Common driver.

23. The method according to claim 16 wherein said Second ID Driver is an LCD Segment Driver.

24. The method according to claim 16 wherein said Second ID Driver is an OLED Segment Driver.

25. The method according to claim 16 wherein said First ID Driver is an LCD Column driver.

26. The method according to claim 16 wherein said First ID Driver is an OLED Column driver.

27. The method according to claim 16 wherein said Second ID Driver is an LCD Row Driver.

28. The method according to claim 16 wherein said Second ID Driver is an OLED Row Driver.

29. The method according to claim 16 wherein said Chip Controlling means is realized in form of a dedicated logic circuit.

30. The method according to claim 16 wherein said Chip Controlling means is realized in form of a finite state machine.

31. A method for implementing a Display interface circuit, capable of realizing control and driver functions for Display devices such as Liquid Crystal Display (LCD) or Organic Light Emitting Diode (OLED) Display devices set-up, configured and operated within the framework of a timing and looping schedule comprising:

providing a Chip Controller block;

providing as Graphic Display Random Access Memory (RAM) a Dynamic RAM (DRAM) block;

providing a Refresh Control block for periodically refreshing the memory cells of said DRAM in order to maintain its information contents during operation;

providing a Data Interface block for communicating between said Display interface circuit and an external information processing system;

providing a Control Registers block for intermediately storing variable control data;

providing a Common Drivers block with outputs driving from first to last Common electrodes said Display device;

providing a Segment Drivers block with outputs driving from first to last Segment electrodes said Display device;

providing a Display Control block for feeding control and data signals to said Common Drivers and Segment Drivers block;

providing a bus system as a bi-directional interconnection means between said Chip Controller block, and said Graphic Display DRAM, Data Interface blocks, and Control Registers blocks;

providing Control Input and Data Input/Output signals for said Data Interface from said external information processing system;

providing a Driver Supply input for said Driver blocks;

connecting output signals from said Chip Controller block to inputs of said Control Registers block and said Refresh Control block;

connecting the output from said Graphic Display DRAM, from said Chip Controller block and Control Registers block as inputs to said Display Control block;

connecting the output from said Refresh Control block as input to said Graphic Display DRAM block;

connecting the output from said Display Control block as input to said Refresh Control block;

connecting each with an output from said Display Control block as input to said Common and Segment Drivers blocks respectively;

connecting each with their outputs from said Common Drivers block and said Segment Drivers block to said Display device respectively;

establishing a looping and timing schedule as operating scheme for said Display Interface circuit capable of implementing graphical Data write and read/refresh cycles with adequate Graphic Display DRAM addressing schemes (e.g. MLA) and thus being able to being continuously operated;

initializing with pre-set Control Registers and pre-set data values a start-up operating cycle of said operating scheme for said Display Interface circuit;

starting said operating scheme for said Display Interface circuit system by feeding said Control Input and Data Input/Output signals from said external information processing system;

writing graphical Data Input into appropriate memory addresses of said Graphic Display DRAM under control and via said Chip Controller block;

reading graphical Data from said Graphic Display DRAM under control of said Chip Controller block and via said Display Control block—also under control of said Chip Controller block—respectively into said Common and Segment Drivers for displaying, whereby the action of reading the DRAM automatically refreshes the data just read;

displaying said graphical Data stored within said Common and Segment Drivers by driving said Display device appropriately; and restarting again said once established operating scheme for said Display interface circuit from said starting point above and continue its looping schedule.

32. A method for implementing an Information Display (ID) system, capable of realizing information storage and display functions in connection with control and driver operations for ID devices, comprising:

providing Data Interfacing means for communicating between said ID system and external information processing systems;

providing Controlling means for operating said ID system;

providing Display Driver Control means for a controlled feeding of control and data signals into ID Driver means, which drive said ID devices;

providing Display Data Storage means being arranged as Random Access Memory (RAM) of exclusively the Dynamic RAM (DRAM) type associated with Memory Control means for reading, writing and periodically refreshing the memory cells of said DRAM in order to maintain its information contents during operation, altogether named as Display DRAM; and operating said ID system by writing information Data received from said Data Interfacing means into said Display DRAM, then reading said information Data from said Display DRAM under control of said Controlling means and transferring said information Data via said Display Driver Control means into said ID Driver means for displaying.

33. A system, realizing an Information Display (ID) interface, capable of implementing information storage and display functions in connection with control and driver operations for ID devices, comprising:

Data Interfacing means for communicating between said ID system and external information processing systems;

Controlling means for operating said ID system;

Display Driver Control means for a controlled feeding of control and data signals into ID Driver means, which drive said ID devices;

Display Data Storage means being arranged as Random Access Memory (RAM) of exclusively the Dynamic RAM (DRAM) type associated with Memory Control means for reading, writing and periodically refreshing the memory cells of said DRAM in order to maintain its information contents during operation, altogether named as Display DRAM; and an operating method for said ID system with a step of writing information Data received from said Data Interfacing means into said Display DRAM, another step reading said information Data from said Display DRAM under control of said Controlling means and a further step of transferring said information Data via said Display Driver Control means into said ID Driver means for displaying on said ID devices.

34. The system according to claim 33 wherein said Display Data Storage means is addressed in Multi-Line Addressing (MLA) mode.

* * * * *